US010174556B2

(12) United States Patent
D'Silva et al.

(10) Patent No.: US 10,174,556 B2
(45) Date of Patent: Jan. 8, 2019

(54) DOWNHOLE DRILLING MOTOR

(71) Applicant: Halliburton Energy Services, Inc., Houston, TX (US)

(72) Inventors: Alben D'Silva, Edmonton (CA); Edgar A. Estrada, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 290 days.

(21) Appl. No.: 14/911,246

(22) PCT Filed: Aug. 29, 2013

(86) PCT No.: PCT/US2013/057341
§ 371 (c)(1),
(2) Date: Feb. 9, 2016

(87) PCT Pub. No.: WO2015/030778
PCT Pub. Date: Mar. 5, 2015

(65) Prior Publication Data

US 2016/0194916 A1 Jul. 7, 2016

(51) Int. Cl.
*E21B 4/02* (2006.01)
*E21B 4/00* (2006.01)

(52) U.S. Cl.
CPC ..... *E21B 4/02* (2013.01); *E21B 4/003* (2013.01)

(58) Field of Classification Search
CPC ..... E21B 4/003; E21B 4/02
See application file for complete search history.

(56) References Cited

U.S. PATENT DOCUMENTS

| | | | | |
|---|---|---|---|---|
| 7,703,550 | B2 | 4/2010 | Nevlud et al. | |
| 2003/0056990 | A1 | 3/2003 | Oglesby | |
| 2006/0021841 | A1 | 2/2006 | Kimes et al. | |
| 2006/0243487 | A1 | 11/2006 | Turner et al. | |
| 2010/0176358 | A1* | 7/2010 | Gray, II | B66D 1/08 254/361 |
| 2011/0142632 | A1 | 6/2011 | Stoltz et al. | |
| 2011/0240313 | A1 | 10/2011 | Knobloch, Jr. et al. | |
| 2012/0273282 | A1 | 11/2012 | Lin et al. | |

FOREIGN PATENT DOCUMENTS

| | | | |
|---|---|---|---|
| CN | 101975159 | A | 2/2011 |
| WO | 2010030272 | A1 | 3/2010 |

OTHER PUBLICATIONS

Russian Search Report dated Aug. 24, 2017; Russian Patent Application No. 2016102798/03.
International Search Report and Written Opinion dated Jan. 15, 2014; International PCT Application No. PCT/US13/57341.

* cited by examiner

*Primary Examiner* — Caroline N Butcher
(74) *Attorney, Agent, or Firm* — McGuireWoods LLP

(57) ABSTRACT

A downhole drilling motor comprises a housing located in a drill string. A power sleeve is located inside the housing and is operatively coupled to a drill bit. The power sleeve has a spiral lobed, elastomer covered internal surface. The power sleeve is rotatable with respect to the outer housing. A lobed shaft is located within the power sleeve. The lobed shaft has a spiral lobed outer surface. An anchoring assembly is engaged between the lobed shaft and the outer housing to limit rotation of the lobed shaft with respect to the housing such that a fluid flow through the downhole drilling motor causes the power sleeve to rotate with respect, to the outer housing and the lobed shaft.

16 Claims, 7 Drawing Sheets

DOWNHOLE DRILLING MOTOR

BACKGROUND OF THE INVENTION

The present disclosure relates generally to the field of drilling wells and more particularly to downhole drilling motors.

Progressive cavity drilling motors commonly have a helical rotor located within the axial cavity of a non-rotating stator, where the stator is connected to the housing of the motor. As the drilling fluid is pumped down through the motor, the fluid rotates the rotor. The rotor may be coupled to a drill bit through a constant velocity (CV) joint, or, alternatively, through a flexible shaft. The torque available to drive the drill bit may be limited by the torsional strength of the output shaft or the CV joints. In addition, the need for the CV joint or the flexible shaft tends to locate the power section further away from the bit resulting in a longer downhole assembly. Such an assembly may have a torsional and/or lateral natural frequency that is excited by the drilling vibration environment downhole causing vibration damage to downhole equipment in proximity to the motor. Such vibration may accelerate wear on the downhole equipment.

DETAILED DESCRIPTION

Figure 1:
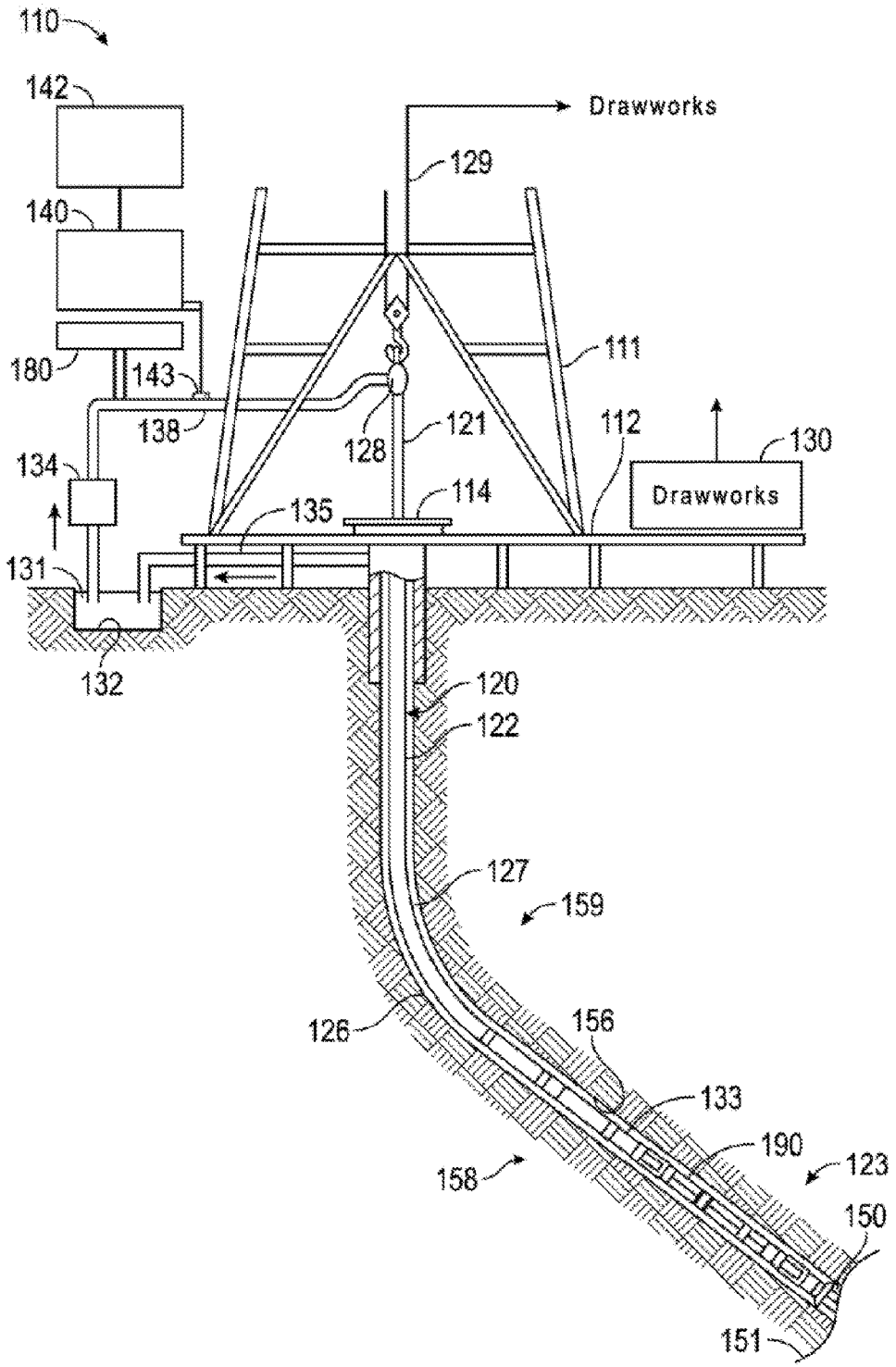
FIG. 1 shows a schematic diagram of a drilling system.

FIG. 1 shows a schematic diagram of a drilling system 110 having a downhole assembly according to one embodiment of the present disclosure. As shown, the system 110 includes a conventional derrick 111 erected on a derrick floor 112, which supports a rotary table 114 that is rotated by a prime mover (not shown) at a desired rotational speed. A drill string 120 that comprises a drill pipe section 122 extends downward from rotary table 114 into a directional borehole 126. Borehole 126 may travel in a three-dimensional path. A drill bit 150 is attached to the downhole end of drill string 120 and disintegrates the geological formation 123 when drill bit 150 is rotated. The drill string 120 is coupled to a drawworks 130 via a kelly joint 121, swivel 128 and line 129 through a system of pulleys (not shown). During the drilling operations, drawworks 130 is operated to control the weight on bit 150 and the rate of penetration of drill string 120 into borehole 126. The operation of drawworks 130 is well known in the art and is thus not described in detail herein.

During drilling operations a suitable drilling fluid (also referred to in the art as "mud") 131 from a mud pit 132 is circulated under pressure through drill string 120 by a mud pump 134. Drilling fluid 131 passes from mud pump 134 into drill string 120 via fluid line 138 and kelly joint 121.

Drilling fluid 131 is discharged at the borehole bottom 151 through an opening, in drill bit 150. Drilling fluid 131 circulates uphole through the annulus 127 between drill string 120 and borehole wall 156 and is discharged into mud pit 132 via a return line 135. Preferably, a variety of sensors (not shown) are appropriately deployed on the surface according to known methods in the art to provide information about various drilling-related parameters, such as fluid flow rate, weight on bit, hook load, etc.

In one example embodiment of the present disclosure, a bottom hole assembly (BHA) 159 may comprise a measurement while drilling (MWD) system 158 comprising various sensors to provide information about the formation 123 and downhole drilling parameters. BHA 159 may be coupled between the drill bit 150 and the drill pipe 122.

MWD sensors in BHA 159 may include, but are not limited to, a sensors for measuring the formation resistivity near the drill bit, a gamma ray instrument for measuring the formation gamma ray intensity, attitude sensors for determining the inclination and azimuth of the drill string, and pressure sensors for measuring drilling fluid pressure downhole. The above-noted sensors may transmit data to a downhole telemetry transmitter 133, which in turn transmits the data uphole to the surface control unit 140. In one embodiment a mud pulse telemetry technique may be used to communicate data from downhole sensors and devices during drilling operations. A transducer 143 placed in the mud supply line 138 detects the mud pulses responsive to the data transmitted by the downhole transmitter 133. Transducer 143 generates electrical signals in response to the mud pressure variations and transmits such signals to a surface control unit 140. Surface control unit 140 may receive signals from downhole sensors and devices via sensor 143 placed in fluid line 138, and processes such signals according to programmed instructions stored in a memory, or other data storage unit, in data communication with surface control unit 140. Surface control unit 140 may display desired drilling parameters and other information on a display/monitor 142 which may be used by an operator to control the drilling operations. Surface control unit 140 may contain a computer, a memory for storing data, a data recorder, and other peripherals. Surface control unit 140 may also have drilling, log interpretation, and directional models stored therein and may process data according to programmed instructions, and respond to user commands entered through a suitable input device, such as a keyboard (not shown).

In other embodiments, other telemetry techniques such as electromagnetic and/or acoustic techniques, or any other suitable technique known in the art may be utilized for the purposes of this invention. In one embodiment, hard-wired drill pipe may be used to communicate between the surface and downhole devices. In one example, combinations of the techniques described may be used. In one embodiment, a surface transmitter receiver 180 communicates with downhole tools using any of the transmission techniques described, for example a mud pulse telemetry technique. This may enable two-way communication between surface control unit 140 and the downhole tools described below.

In one embodiment, a novel downhole drilling motor 190 is included in drill string 120. Downhole drilling motor 190 may be a fluid driven, progressive cavity drilling motor that uses drilling fluid to rotate an output member that may be operatively coupled to drill bit 150. Prior art drilling motors commonly have a helical rotor located within the axial cavity of a non-rotating elastomer, or elastomer coated, stator that is connected to the housing of the motor. As the drilling fluid is pumped down through the motor, the fluid rotates the rotor. The rotor may be coupled to drill bit 150 through a coupling shaft that may comprise a constant velocity (CV) joint, or, alternatively, through a flexible coupling shaft. The torque available to drive drill bit 150 may be limited by the torsional strength of the output shaft or the CV joints. In addition, the need for the CV joint or the flexible shaft tends to locate the power section further away from the bit resulting in a longer downhole assembly. Such a longer assembly may be more flexible than a shorter one. The more flexible assembly may be more prone to excitation by the drilling vibration environment downhole causing vibration damage to downhole equipment in proximity to the motor.

Figure 3:
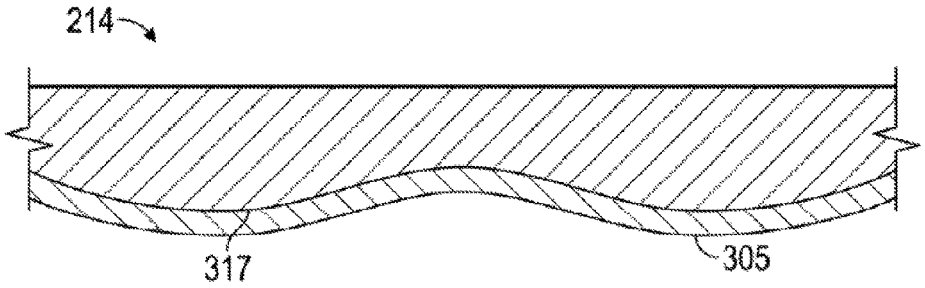
FIG. 3 shows one example of a power sleeve elastomer in a downhole motor.
Figure 4:
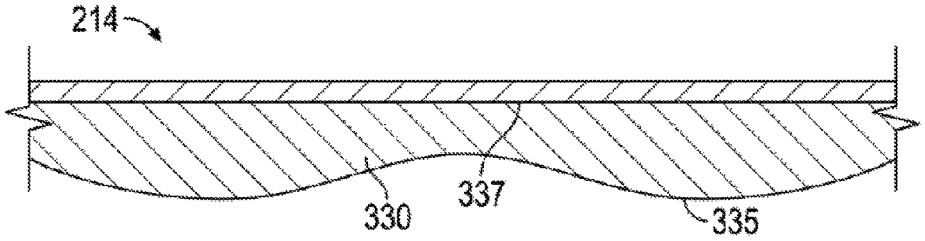
FIG. 4 shows another example of a power sleeve elastomer in a downhole motor.

In contrast to the common prior art motor described above, FIG. 2 shows a downhole motor, 190, that has a spiral lobed stationary shaft and a rotating power sleeve 214. Power sleeve 214 has an internal spiral lobed shape having one more lobe than that of non-rotating shaft 220. In one example, see FIG. 3, the inner surface 216 of power sleeve 214 may comprise a lobed surface 317 formed on the internal surface of power sleeve 214. An elastomer layer 305 may be formed over the lobed surface 317. Alternatively, see FIG. 4, an elastomer sleeve 330, having a lobed inner surface, may be molded to a formed cylindrical inner surface 337 of power sleeve 214 using techniques known in the art. The elastomer material may be any natural, or synthetic elastomer known in the art to be suitable for downhole motors. One skilled in the art will appreciate that the particular elastomer used may be application specific to ensure compatibility between the motor elastomer and the drilling fluid used. Example elastomers include, but are not limited to, nitrile, hydrogenated nitrile, and ethylene-propylene diene monomer (EPDM).

Referring back to FIG. 2, housing 200 may comprise an upper housing section 201 threadedly coupled to a lower housing section 205. In addition upper housing section is threadedly coupled to BHA 159 such that housing 200 rotates with BHA 159 and drill string 120. Power sleeve 214 is rotatable with respect to housing 200 via radial bearings 225. In one example, radial bearings 225 may comprise mud lubricated journal bearings that have mating bearing surfaces coated with an abrasion resistant coating material. Such abrasion resistant coatings may include, but are not limited to: a natural diamond coating, a synthetic diamond coating, a tungsten coating, a tungsten carbide coating, and combinations thereof.

Figure 2:
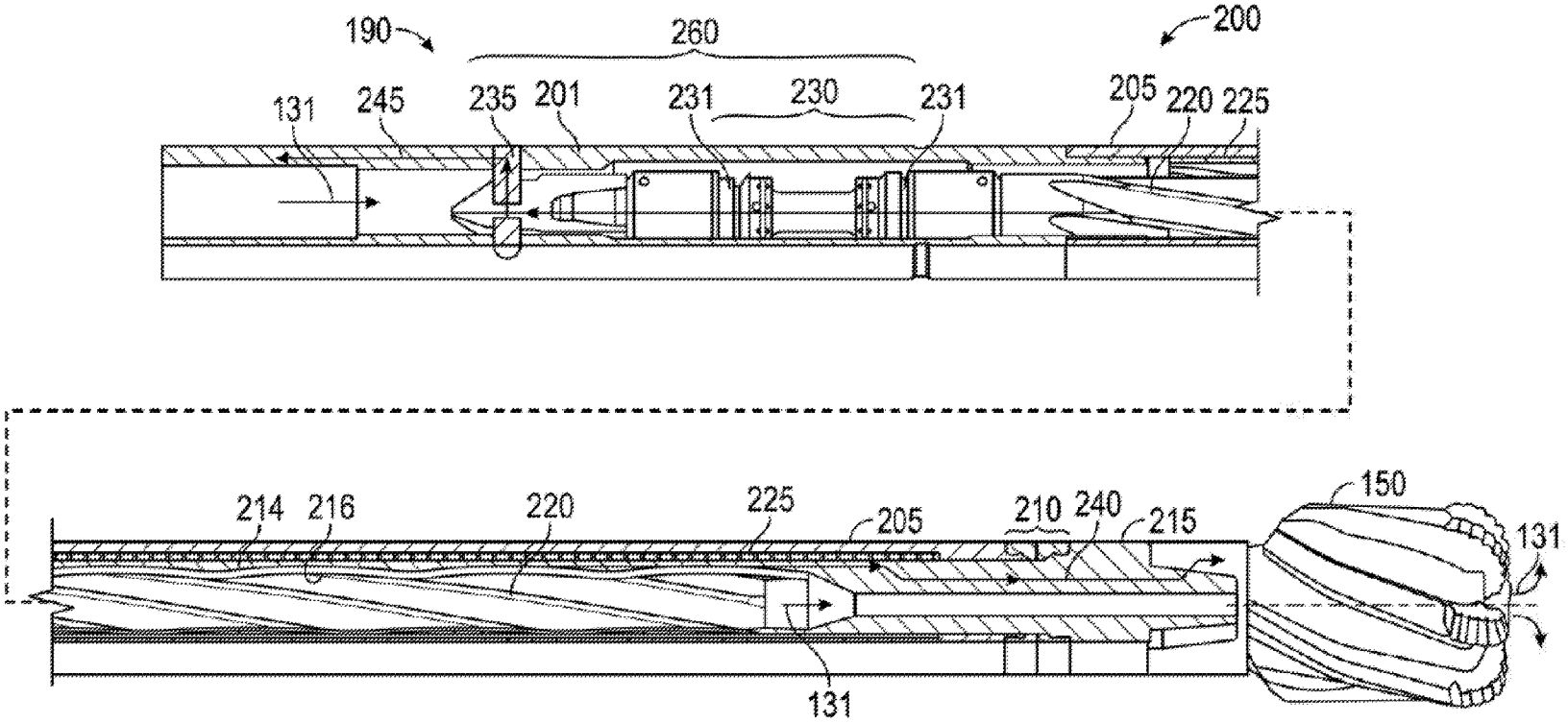
FIG. 2 shows a diagram of one embodiment of a downhole motor.
Figure 5:
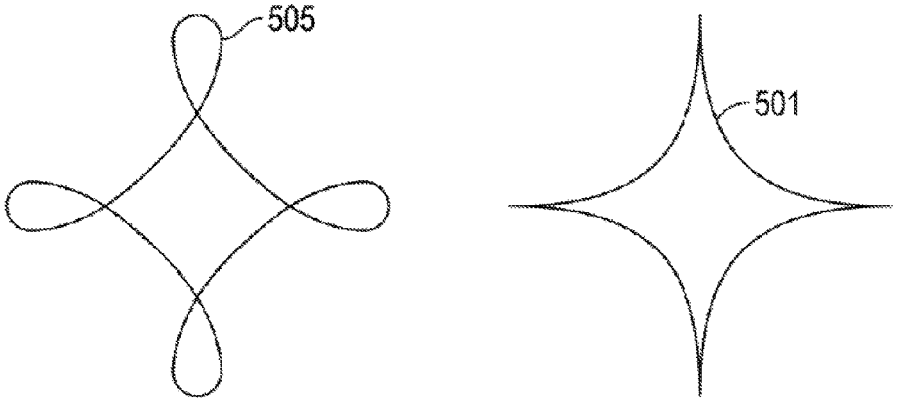
FIG. 5 shows an axial view of the predicted motion of a lobed shaft in a motor of the present disclosure contrasted to the shaft motion in a prior art motor.

In one embodiment, non-rotating shaft 220 is coupled to upper housing 201 through an anchoring assembly 260. In the embodiment of FIG. 2, anchoring assembly 260 may comprise coupling shaft assembly 230 and anchoring pin 235. In the embodiment shown, coupling shaft assembly 230 comprises at least one constant velocity joint 231. As drilling fluid 131 flows through the motor assembly, non-rotating shaft 220 articulates inside of power sleeve 214. Coupling shaft assembly 230 accommodates this motion while transferring any generated reaction torque through anchoring pin 235 to upper housing 201. FIG. 5 shows an axial projection of the predicted path 501 of non-rotating shaft 220 as compared to the predicted path 505 of a traditional motor, wherein the traditional shaft rotates relative to a non-rotating stator. The reduced motion 501 may reduce the wear rate of the power sleeve elastomer as compared to elastomer wear rate of the elastomer in the traditional motor. In addition, the reduced overall motion 501 of the non-rotating shaft 220 may reduce the vibration levels in the disclosed motor, when compared to a traditional motor of comparable output.

Still referring to FIG. 2, axial thrust bearing 210 provides for rotational movement between the output coupling section 215 of power sleeve 214 and lower housing 205. Output coupling section 215 may be coupled to bit 150. Arrows 240 shows the torque path from power section 214 to bit 150 as drilling fluid 131 flows through the disclosed motor 190. Similarly, arrows 245 show the reaction torque path from the non-rotating shaft 220 to the upper housing section 201. As discussed above, for motors of the same size and material strengths, the larger cross-sectional moment of inertia of the power sleeve relative to the rotor and CV joints of a prior art motor, provide more power to the bit with the motor of the present disclosure.

Figure 6:
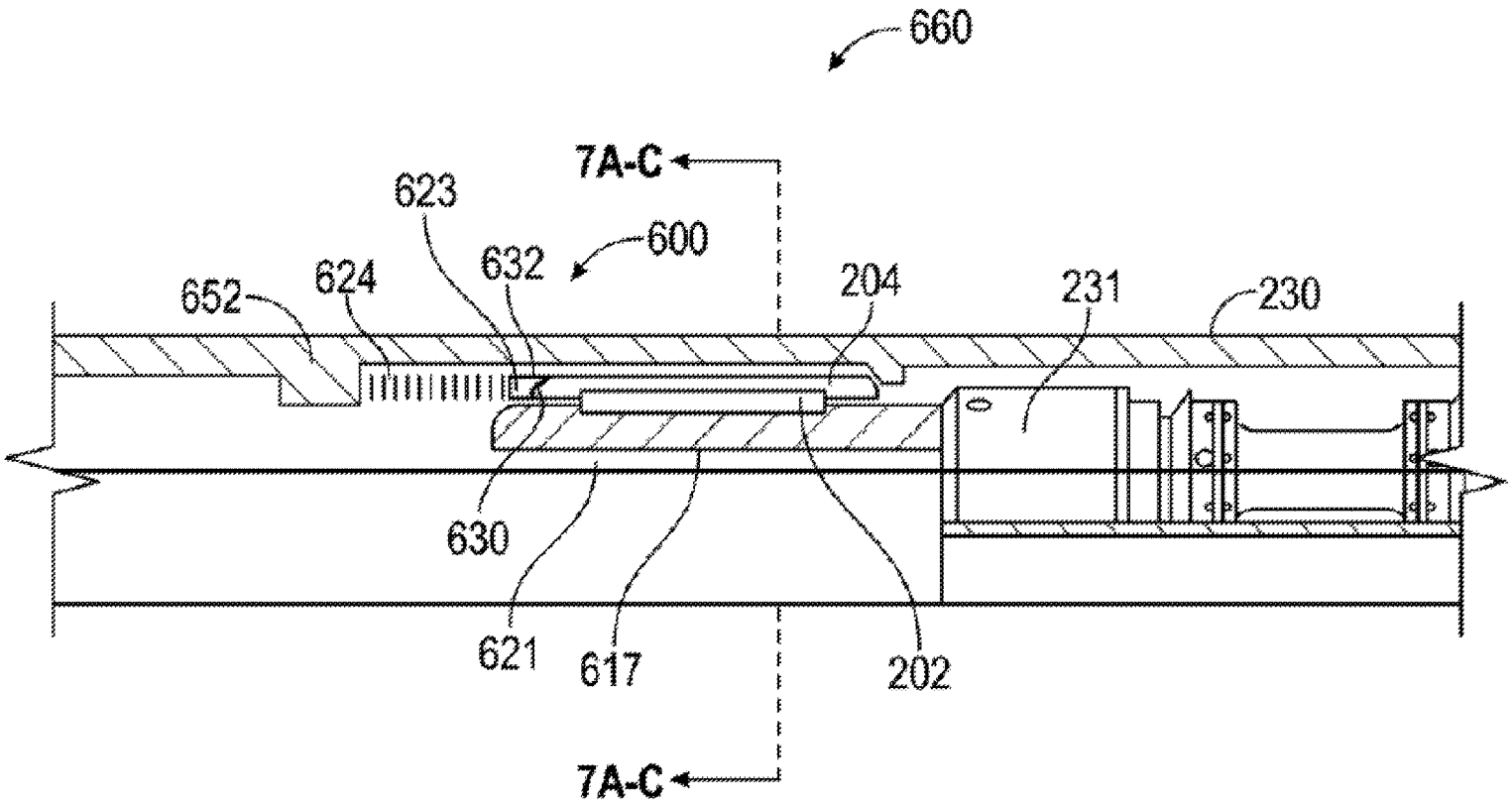
FIG. 6 is a cross-sectional view of an example of downhole torque limiting assembly.

In another embodiment, see FIG. 6, anchoring assembly 660 comprises a torque limiting assembly 600 coupled between coupling shaft assembly 230 and outer housing 652 to limit the torque transmitted during stalls. FIG. 6 is a cross-sectional view of an example of torque limiting assembly 600. Drive shaft 617 is coupled to the upper constant velocity joint of coupling shaft assembly 230. In operation, when the torque forces developed across the downhole torque limiting assembly 600 are substantially zero, radial ratchet members 204 will be in a generally compressed configuration. In operation, as the amount of torque developed across downhole torque limiting assembly 600 increases, the radial ratchet members 204 are urged radially outward. This process of radially outward expansion is discussed further in the descriptions of FIGS. 7A-7C.

A spring, section 624 compresses the spring support members 623 axially. Such compression compliantly urges the radial ratchet members 204 radially inward. In use, torque forces developed along the downhole torque limiting assembly 600 act to urge the radial ratchet members 204 radially outward. This outward expansion causes the angular faces 230 to impart an axial force against the angular faces 613, urging the spring support members 623 axially away from the radial ratchet assembly 621, which in turn compresses the spring section 624.

In some embodiments, the spring section 624 can each include a collection of one or more frusto-conical springs (e.g., coned-disc springs, conical spring washers, disc springs, cupped spring washers, Belleville springs, Belleville washers). In some implementations, the springs can be helical compression springs, such as die springs. In some implementations, multiple springs may be stacked to modify the spring constant provided by the spring section 624. In some implementations, multiple springs may be stacked to modify the amount of deflection provided by the spring section 624. For example, stacking springs in the same direction can add the spring constant in parallel, creating a stiffer joint with substantially the same deflection. In another example, stacking springs in an alternating direction can perform substantially the same functions as adding springs in series, resulting in a lower spring, constant and greater deflection. In some implementations, mixing and/or matching spring directions can provide a predetermined spring constant and deflection capacity. In some implementations, by altering the deflection and/or spring constant of the spring section 624, the amount of torque required to cause the downhole torque limiting assembly 600 to enter a torque limiting mode can be likewise altered.

Figure 7A:
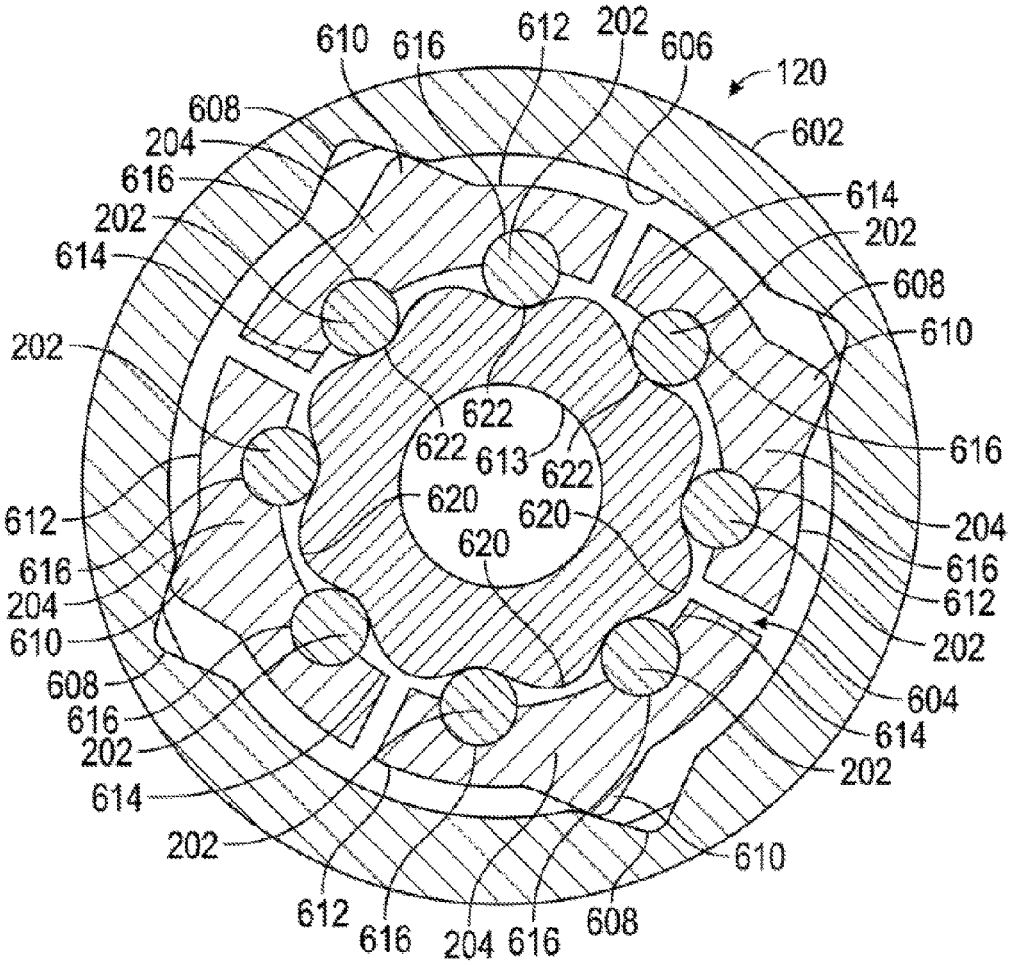
FIGS. 7A-7C are cross-sectional views of the example of the downhole torque limiting assembly 600 of FIG. 6.
Figure 7B:
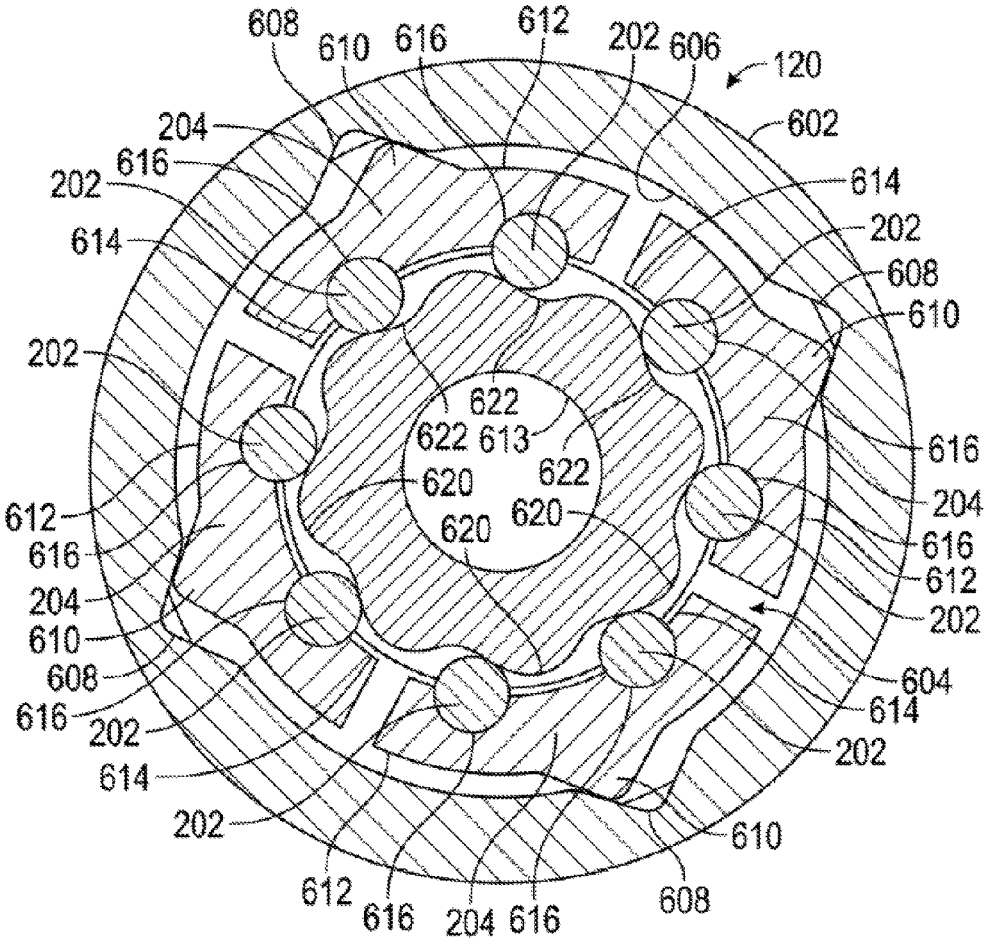
Figure 7C:
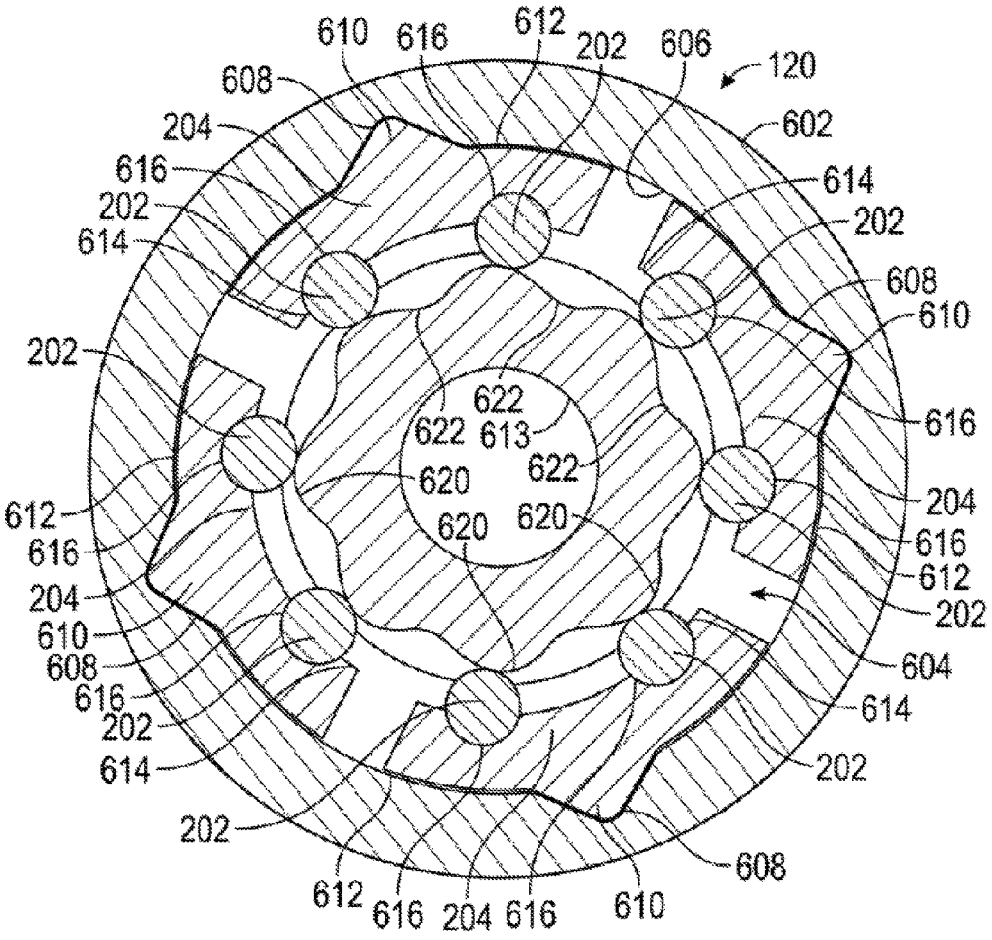

FIGS. 7A-7C are cross-sectional views of the example of the downhole torque limiting assembly 600 of FIG. 6. Referring to FIG. 7A, the downhole torque limiting assembly 600 includes an outer housing 652 (corresponding to the upper housing 201 of FIG. 2). The outer housing 652 includes an internal cavity 604. The internal cavity 604 includes an internal surface 606, which includes a collection of receptacles 608.

The radial ratchet members 204 include one or more projections ("sprags") 610 that extend radially outward from a radially outward surface 613. In use, the sprags 610 are at least partly retained within the receptacles 608 (hereinafter referred to as "sprag receptacles"). It will be understood that the sprag 610 is illustrated as triangular shaped. However it will be understood that other geometric configurations of the projection and a matting receptacle may be used and that "sprag" and sprag shape is not limited to a triangular configuration.

As discussed previously, the radial ratchet members 204 also include a radially inner surface 614. The radially inner surface 614 includes at least one semicircular recess 616. Each semicircular recess 616 is formed to partly retain a corresponding one of the collection of roller bearings 202. The collection of roller bearings 202 is substantially held in rolling contact with the drive shaft 617.

The drive shaft 617 includes a collection of radial protrusions 620 and radial recesses 622. Under the compression provided by the spring sections 624 (e.g., FIG. 6), the radial ratchet members 204 are urged radially inward. As such, under conditions in which the downhole torque limiting assembly 600 is experiencing substantially zero torque, the roller bearings 202 will be rolled to substantially the bases of the radial recesses 622 (e.g., allowing the spring sections 624 to rest at a point of relatively low potential energy).

FIG. 7B illustrates an example of the radial ratchet assembly 621 with some torque (e.g., an amount of torque less than a predetermined torque threshold) being developed between the drive shaft 617 and the outer housing 652. In use, the torque generated by the downhole motor is transferred through shaft 617, transferred to the roller bearings 202, to the radial ratchet members 204, and to the outer housing 652.

As torque forces between the outer housing 652 and the drive shaft 617 increase, the roller bearings 202 are partly urged out of the radial recesses 622 toward neighboring radial protrusions 620. As the roller bearings 202 are urged toward the radial protrusions 620, the radial ratchet members 204 comply by extending radially outward in opposition to the compressive forces provided by the spring sections 624 (not shown). As the radial ratchet members 204 extend outward, contact between the sprags 610 and the sprag receptacles 608 is substantially maintained as the sprags 610 penetrate further into the sprag receptacles 608.

In implementations in which the torque developed between the drive shaft 617 and the outer housing 652 is less than a predetermined torque threshold, rotational forces can continue to be imparted to the drive shaft 617 from the outer housing 652. In some implementations, the predetermined torque threshold can be set through selective configuration of the spring sections 624.

FIG. 7C illustrates an example of the radial ratchet assembly 621 with an excess torque (e.g., an amount of torque greater than a predetermined torque threshold) being developed between the drive shaft 617 and the outer housing 652. The operation of the radial ratchet assembly 621 substantially decouples the transfer of rotational energy to the drive shaft 617 from the outer housing 652 when torque levels are in excess of the predetermined torque threshold.

In operation, an excess torque level causes the roller bearings 202 to roll further toward the radial protrusions 620. Eventually, as depicted in FIG. 7C, the present example, the radial ratchet members 204 comply sufficiently to allow the roller bearings 202 to reach the peaks of the radial protrusions 620. In such a configuration, the rotational force of the outer housing 652 imparted to the radial ratchet members 204 is substantially unable to be transferred as rotational energy to the roller bearings 202, and as such, the drive, shaft 617 becomes substantially rotationally decoupled from the outer housing 652.

In the examples discussed in the descriptions of FIGS. 6-7C, the radial ratchet assembly 621 may be bidirectionally operable, e.g., the torque limiting function of the downhole torque limiting assembly 600 can operate substantially the same under clockwise or counterclockwise torques. In some implementations, the radial ratchet assembly 621, the outer housing 652, and/or the drive shaft 617 may be formed to provide a torque limiting assembly that is unidirectional.

In some implementations, the roller bearings 202 may be replaced by sliding bearings. For example, the radial ratchet members 204 may include semicircular protrusions extending radially inward from the radially inner surface of the ratchet member 604. These semicircular protrusions may rest within the radial recesses 622 during low-torque conditions, and be slidably urged toward the radial protrusions 620 as torque levels increase.

In some implementations, multiple sets of radial ratchet assemblies may be used together. For example, the torque limiting assembly 600 can include two or more of the radial ratchet assemblies 620 in parallel to increase the torque capability available between the drilling, rig 10 and the drill bit 50.

Although the present disclosure and its advantages have been described in detail, it should be understood that various changes, substitutions and alterations can be made herein without departing from the scope of the disclosure as defined by the following claims.

The invention claimed is:

1. A downhole drilling motor comprising:

a housing located in a drill string;

a power sleeve located inside the housing and operatively coupled to a drill bit, the power sleeve having a spiral lobed, elastomer covered internal surface, the power sleeve being rotatable with respect to the housing;

a lobed shaft located within the power sleeve, the shaft comprising a spiral lobed outer surface; and an anchoring assembly engaged between the lobed shaft and the housing to limit rotation of the lobed shaft with respect to the housing such that a fluid flow through the downhole drilling motor causes the power sleeve to rotate with respect to the housing and the lobed shaft.

2. The downhole drilling motor of claim 1 further comprising a radial bearing located between the housing and the power sleeve.

3. The downhole drilling motor of claim 2 wherein the radial bearing comprises a metallic material.

4. The downhole drilling motor of claim 3 wherein the metallic radial bearing material is at least partially coated with a material chosen from the group consisting of: a natural diamond material; a synthetic diamond material; a tungsten carbide material; a silicon carbide material; and combinations thereof.

5. The downhole drilling motor of claim 1 wherein the anchoring assembly comprises at least one of: an anchoring pin, and a torque limiting assembly.

6. The downhole drilling motor of claim 5 wherein the torque limiting assembly comprises:

a housing having an internal cavity, the internal cavity having a surface including a plurality of sprag receptacles;

a shaft disposed within the internal cavity of the housing, the shaft having a plurality of radial protrusions and radial recesses;

a plurality of radial ratchet members disposed radially between the housing and the shaft, each radial ratchet member having a radially inner surface, and a radially outward surface that includes at least one radially protruding sprag;

a plurality of bearings disposed radially between the plurality of radial ratchet members and the shaft; and a retaining assembly comprising a compliant member to provide a compliant force sufficient to maintain the plurality of ratchet members, the plurality of bearings, and the shaft in a first position to transmit a torque between the housing and the shaft when the torque is below a predetermined limit between the housing and the shaft, and to allow the ratchet members, the plurality of bearings, and the shaft to attain a second position when the torque exceed the predetermined limit such that slippage occurs between the housing and the shaft.

7. The downhole drilling motor of claim 6 wherein the compliant member comprises at least one spring chosen from the group consisting of: a helical spring, a coned-disc spring, a conical spring washer, a disc spring, a cupped spring washer, and a Belleville spring.

8. A method to enhance the power delivered to a drill bit by a downhole motor comprising:

locating a housing in a drill string;

locating a power sleeve inside the housing and operatively coupling the power sleeve to a drill bit, the power sleeve having a spiral lobed, elastomer covered internal surface, the power sleeve being rotatable with respect to the outer housing;

locating a lobed shaft within the hollow power sleeve, the lobed shaft comprising a spiral lobed outer surface; and engaging an anchoring assembly between the lobed shaft and the housing to prevent rotation of the lobed shaft with respect to the housing such that a fluid flow through the downhole drilling motor causes the power sleeve to rotate with respect to the housing and the lobed shaft.

9. The method of claim 8 further comprising locating a radial bearing between the housing and the power sleeve.

10. The method of claim 9 wherein the radial bearing comprises a metallic material.

11. The method of claim 10 wherein the metallic radial bearing material is at least partially coated with a material chosen from the group consisting of: a natural diamond material; a synthetic diamond material; a tungsten carbide material; a silicon carbide material; and combinations thereof.

12. The method of claim 8 further comprising engaging a coupling shaft assembly between the lobed shaft and anchoring assembly.

13. The method of claim 12 wherein the coupling shaft assembly comprises at least one constant velocity joint.

14. The method of claim 8 wherein the anchoring assembly comprises at least one of: an anchoring pin, and a torque limiting assembly.

15. The method of claim 14 wherein the torque limiting assembly comprises:

a housing having an internal cavity, the internal cavity having a surface including a plurality of sprag receptacles;

a shaft disposed within the internal cavity of the housing, the shaft having a plurality of radial protrusions and radial recesses;

a plurality of radial ratchet members disposed radially between the housing and the shaft, each radial ratchet member having a radially inner surface, and a radially outward surface that includes at least one radially protruding sprag;

a plurality of bearings disposed radially between the plurality of radial ratchet members and the shaft; and a retaining assembly comprising a compliant member to provide a compliant force sufficient to maintain the plurality of ratchet members, the plurality of bearings, and the shaft in a first position to transmit a torque between the housing and the shaft when the torque is below a predetermined limit between the housing and the shaft, and to allow the ratchet members, the plurality of bearings, and the shaft to attain a second position when the torque exceed the predetermined limit such that slippage occurs between the housing and the shaft.

16. The method of claim 15 wherein the compliant member comprises at least one spring chosen from the group consisting of: a helical spring, a coned-disc spring, a conical spring washer, a disc spring, a cupped spring washer, and a Belleville spring.

* * * * *